US007290428B2

(12) United States Patent
Zauhar

(10) Patent No.: US 7,290,428 B2
(45) Date of Patent: Nov. 6, 2007

(54) CAN BOTTOM FORMING ASSEMBLY

(76) Inventor: Mark L. Zauhar, 18756 Knollwood Cir., Lakeville, MN (US) 55044

( * ) Notice: Subject to any disclaimer, the term of this patent is extended or adjusted under 35 U.S.C. 154(b) by 2 days.

(21) Appl. No.: 11/346,132

(22) Filed: Feb. 2, 2006

(65) Prior Publication Data

US 2006/0225479 A1 Oct. 12, 2006

Related U.S. Application Data

(60) Provisional application No. 60/649,624, filed on Feb. 2, 2005.

(51) Int. Cl.
*B21D 22/00* (2006.01)

(52) U.S. Cl. ..... 72/348; 72/453.13

(58) Field of Classification Search ..... 72/348, 72/354.8, 347, 466, 466.7; 413/56, 62; 285/316
See application file for complete search history.

(56) References Cited

U.S. PATENT DOCUMENTS 2,038,466 A * 4/1936 Yates ..... 464/141
4,324,124 A * 4/1982 Maeder ..... 72/345
4,930,330 A 6/1990 Weishalla
5,797,292 A * 8/1998 Johansson et al. ..... 72/348
6,070,447 A * 6/2000 Bone et al. ..... 72/348
6,351,981 B1 * 3/2002 Jowitt et al. ..... 72/348
6,490,904 B1 12/2002 Zauhar

* cited by examiner

*Primary Examiner*—Derris H. Banks
*Assistant Examiner*—Debra M Wolfe
(74) *Attorney, Agent, or Firm*—Anthony G. Eggink; Katrina M. Eggink

(57) ABSTRACT

A can bottom forming assembly for use in forming the bottom of metal cans, such as steel and aluminum two piece cans. The bottom forming assembly is lightweight and comprises outer and cylinder housing assemblies which house a clamp ring retainer assembly, a transfer piston assembly and a spring member. The clamp ring retainer assembly includes biasing members to float a clamp ring thereby centering the clamp ring and domer die plug with respect to the ram of a bodymaker.

19 Claims, 15 Drawing Sheets

CAN BOTTOM FORMING ASSEMBLY

This invention claims the benefit of U.S. Provisional Application Ser. No. 60/649,624, filed on or about Feb. 2, 2005.

BACKGROUND OF THE INVENTION

The present invention relates generally to assemblies used in the manufacture of metal containers. Particularly, the invention relates to a bottom forming assembly used in the drawing and forming of the bottom portions of two piece steel and aluminum cans.

The can bottom forming assembly of the present invention is an improvement of the bottom formers disclosed in U.S. Pat. No. 4,930,330 ('330 Patent) to Weishalla, entitled Double Action Bottom Former, and U.S. Pat. No. 6,490,904 B1 ('904 Patent) to Zauhar, entitled Double Action Bottom Former for High Cyclic Operation, both owned by the Assignee of the present invention. The bottom formers of the '330 and '904 Patents, incorporated by reference herein, are constructed and arranged for cooperating use with a can bodymaker and specifically, the bodymaker punch carrying the can bodies. The '330 Patent and the '904 Patent disclose dome plug positioning structures for bottom forming assemblies. The present invention provides further improvements for can bottom forming assemblies.

The '330 and '904 Patents describe can bottom forming processes including the action of the punch or ram of a can bodymaker assembly with respect to a bottom forming assembly. Bottom forming assemblies are typically constructed and arranged to cooperate with bodymaker assemblies. The bottom former receives can bodies on the rapid cycling bodymaker punch and forms two piece can body bottoms through a drawing and final forming process utilizing a clamp ring and dome plug. The term clamp ring is also known in the industry as a pressure ring, guide ring or outer die. The term dome plug is also known in the industry as an inner die or dome post. The specific manufacture of cans, beverage or food, may determine the use of the particular term. Spatial control of the clamp or guide ring along and normal to the axis of ram movement is imperative for manufacturing quality, production and efficiency. The bottom forming assemblies of the present invention improve these manufacturing parameters by providing a lightweight, easy to maintain and service bottom forming assembly having a novel arrangement of components to improve the centering and biasing control of the clamp ring.

SUMMARY OF THE INVENTION

The present invention provides a bottom forming assembly which is a lightweight, easy to service doming assembly which floats a clamp ring to respond to variations in bodymaker punch locations. The bottom forming assemblies of the invention include two embodiments having a novel arrangement of bottom former components, a lightweight construction and an improved biasing means to float the clamp ring.

In making a two piece can body, the walls of the can body are formed in a bodymaker assembly, the operation of which is described in the '330 and '904 Patents which are incorporated by reference herein. Typically, a punch, i.e. from the bodymaker structure, carries the can body out of the tool pack to the clamp ring of the bottom forming assembly. In the improved bottom forming assemblies of the present invention, the clamp ring is constructed and arranged to float to thereby guide the punch to the center of the doming assembly and to re-center upon the exit of the punch. As the punch travels into the bottom forming assembly, the clamp ring structure axially centers the punch with the dome plug. When making two piece beverage cans, the clamp ring is used as a draw ring to apply pressure on the can material as it flows into the dome, thus controlling the material flow and preventing wrinkles. When making two piece food cans, the clamp ring acts as a guide member to align grooves in the punch with mating grooves in the inner die or dome plug.

A first embodiment of the bottom forming assembly of the present invention is comprised of a clamp ring assembly, a dome plug, a transfer piston assembly, a spring member housed in an outer housing assembly, a piston assembly and a cylinder housing assembly. A cover chamber is located at the end of the bottom forming assembly which defines a pressure build-up and release chamber. The assembly is preferably mounted to a bodymaker using a mounting flange, at least one spacer member, the outer and cylinder housings and tension bolts. The clamp ring is floated using a plurality of hardened pins which are under air pressure force.

A second embodiment is comprised generally of the same components and has the further advantage of easy servicing in that the assembly need not be removed from the bodymaker for spring or hardware changes. The second embodiment includes alternate configurations of the outer housing assembly, clamp ring retainer assembly and transfer piston assembly, as well as the relative cooperating compositions of the assemblies. The alternate construction of the clamp ring retainer assembly further provides easier access to the inside of the bottom former assembly and better dome plug retention.

It is an advantage of the present invention to float the clamp ring to thereby improve production and product quality, i.e., by reducing the chance of can deformities, for example split or cracked domes caused by off-center hits. It is an advantage of the present invention to provide an improved bottom forming assembly which is constructed and arranged to be have a reduced weight in comparison with prior art doming assemblies. It is a further advantage of the present invention to provide an improved bottom forming assembly which is constructed and arranged having a center of gravity which is located closer to the tool pack assembly, of a bottom forming assembly, for example. It is another advantage of the present invention to provide novel component arrangement and compositions for a bottom forming assembly to provide the improved center of gravity. It is a further advantage of the present invention to provide a bottom forming assembly which is more economically serviceable.

These and other benefits and advantages of this invention will become clear from the following description by reference to the drawings.

DESCRIPTION OF THE PREFERRED EMBODIMENTS

The can bottom forming assemblies of the present invention provide a lightweight bottom forming assembly which provides a floated clamp ring to center the ram or punch of a bodymaker.

Figure 1:
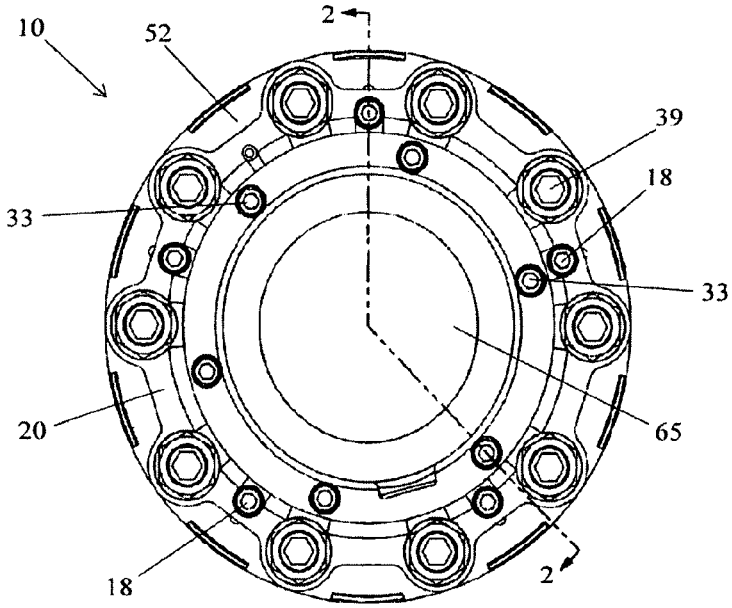
FIG. 1 is a front plan view of the can bottom forming assembly of the present invention.
Figure 2:
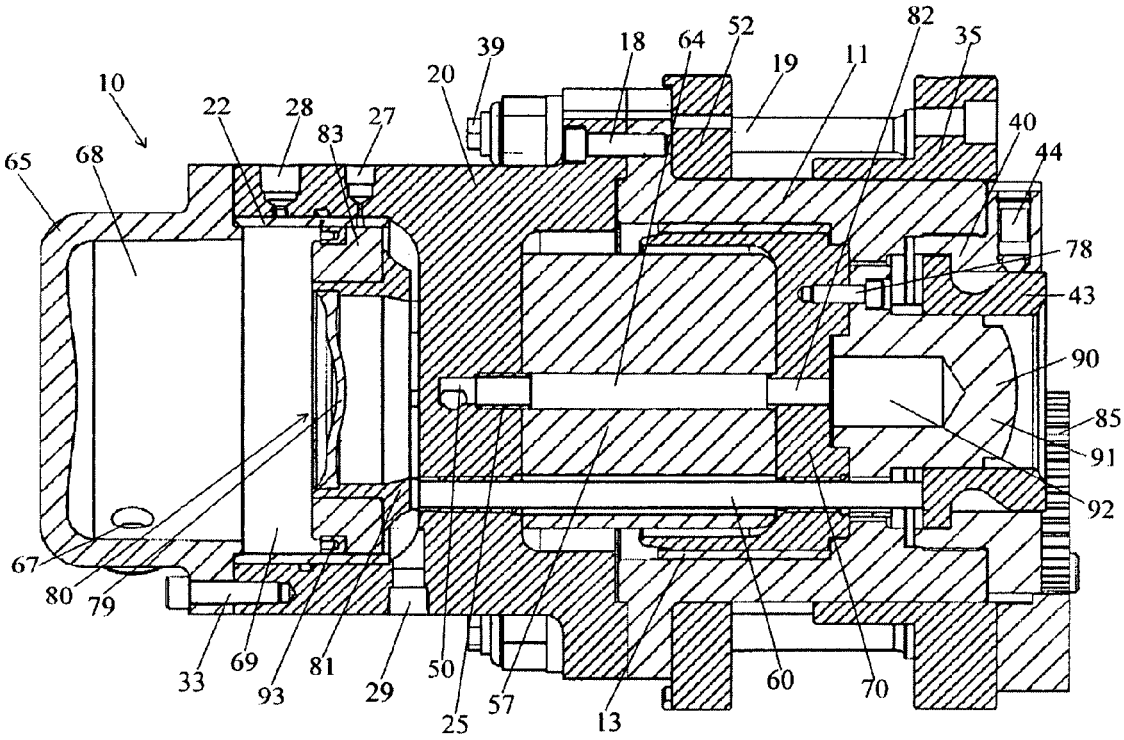
FIG. 2 is a sectional view of the bottom forming assembly of FIG. 1 taken along line 2-2.

Referring to FIGS. 1 and 2, bottom forming assembly 10 is shown having outer housing assembly 11 and cylinder housing assembly 20. Clamp ring retainer assembly 40 having biasing means 44 is shown at the front of the bottom forming assembly and holding floating clamp ring 43. Clamp ring retainer assembly 40 is shown held in place by locking device 85. The clamp ring retainer assembly 40 is shown positioned adjacent dome plug assembly 90 and abutting outer housing assembly 11. Outer housing assembly 11 is shown having bushing 13 which cooperates with transfer piston assembly 70. Transfer piston assembly 70 is shown attached to dome plug assembly 90 via fastener 78. Transfer piston assembly 70 is shown adjacent spring member 57 and push rods 60 are shown extending from clamp ring 43 and through transfer piston assembly 70, spring member 57 and cylinder housing 20. Push rod 60 is shown ending at piston assembly 80 which slidably moves within chamber 69 via bushing 22. Dome plug assembly 90 is shown having body 91 and defining vent cavity 92. Cavity 92 is shown in communication with aperture 82 of transfer piston assembly 70, aperture 64 of spring member and insert 25 and drain channel 50 of cylinder housing assembly 20.

Cylinder housing assembly 20 is shown attached to outer housing assembly via fasteners 18. Cover chamber 65 is shown forming chamber 68 and is shown attached to the end of the bottom forming assembly 10, namely to cylinder housing 20, via fasteners 33. Cylinder housing 20 is shown having oil inlet aperture 27, coolant inlet 28, and coolant drain 29. The bottom forming assemblies of this invention are constructed and arranged to be attached to a bodymaker door using mounting flange 35, spacer 52 and ten tension bolts 19 having hex-heads 39.

Figure 3:
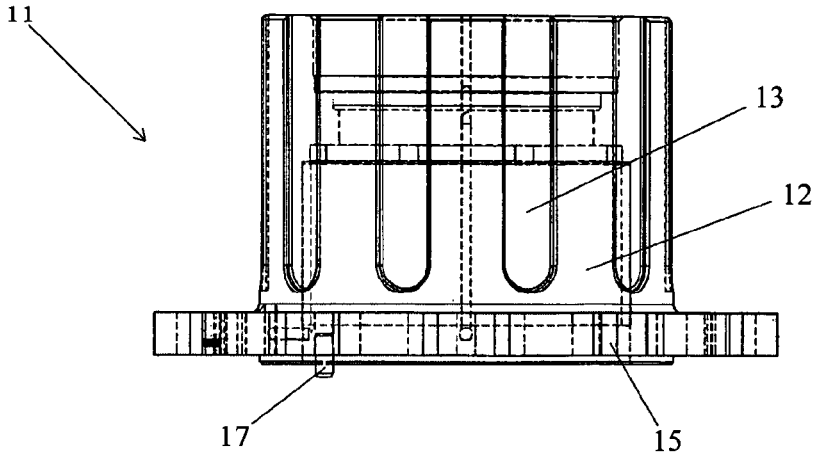
FIG. 3 is a top perspective view of the outer housing assembly of the assembly of FIG. 1.
Figure 4:
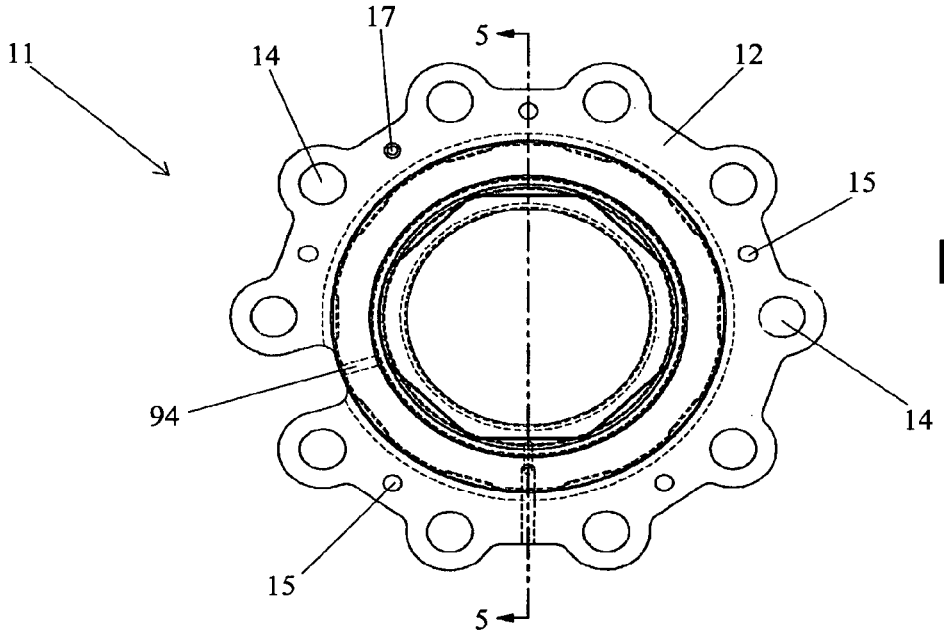
FIG. 4 is a front plan view of the outer housing assembly of FIG. 3.
Figure 5:
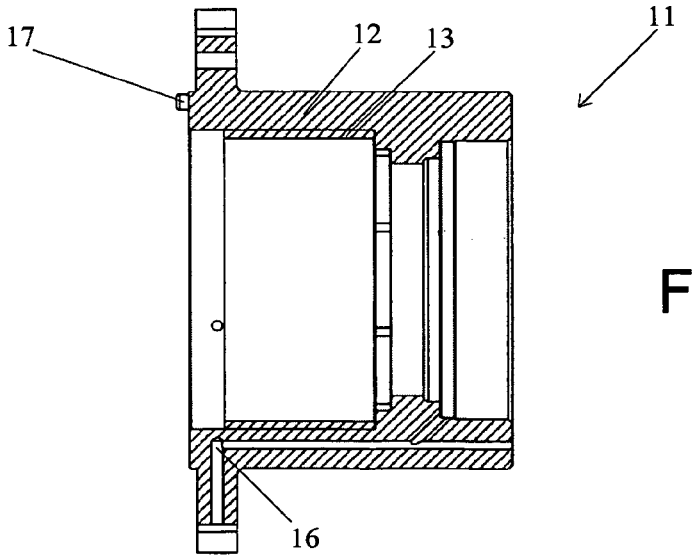
FIG. 5 is a sectional view of the outer housing assembly of FIG. 4 taken along line 5-5.

FIGS. 3-5 show outer housing assembly 11 having a generally cylindrical body 12 and cooperating with bushing 13. Bushing 13 is preferably constructed of a polymeric composite material, such as those manufactured by HyComp, Inc., or similar polymeric, self-lubricating materials. Apertures 14 are shown and are constructed and arranged to receive tension bolts 19 (shown in FIG. 2). Apertures 15 are shown and are constructed and arranged to receive fasteners 18 (shown in FIG. 2). Fasteners 18 are further utilized in apertures 32 of cylinder housing body 21, which will be further discussed below with respect to FIG. 6. Drain 16 is further shown and is provided to remove excess coolant or oil. Dowel pin 17 is shown extending from outer housing assembly and is for further alignment and securement of outer housing assembly 11 to cylinder housing assembly 20. Outer housing assembly 11 is preferably constructed of tool steel or a like hard material.

In use, the punch of the bodymaker which carries the can body to the bottom former assembly 10 strikes the can body against the clamp ring assembly and exerts force on the transfer piston assembly and spring member. The transfer piston assembly 70 moves and compresses the spring member 57. It is desirable to measure this movement, for example using overtravel measuring device 94 (shown in FIG. 4) contained in outer housing assembly 11, to measure the movement within the bottom forming assembly and make necessary adjustments, for example changing the spring member or adjusting the bottom former position if excessive overtravel is detected.

Figure 6:
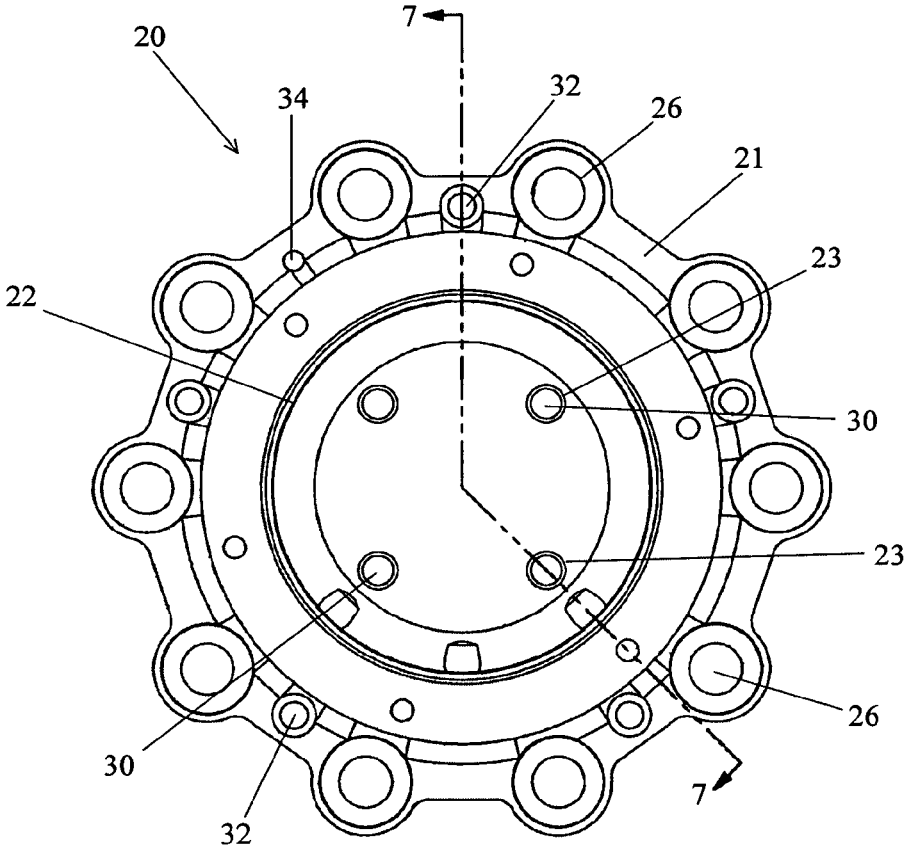
FIG. 6 is a front plan view of the cylinder housing assembly of the assembly of FIG. 1.
Figure 7:
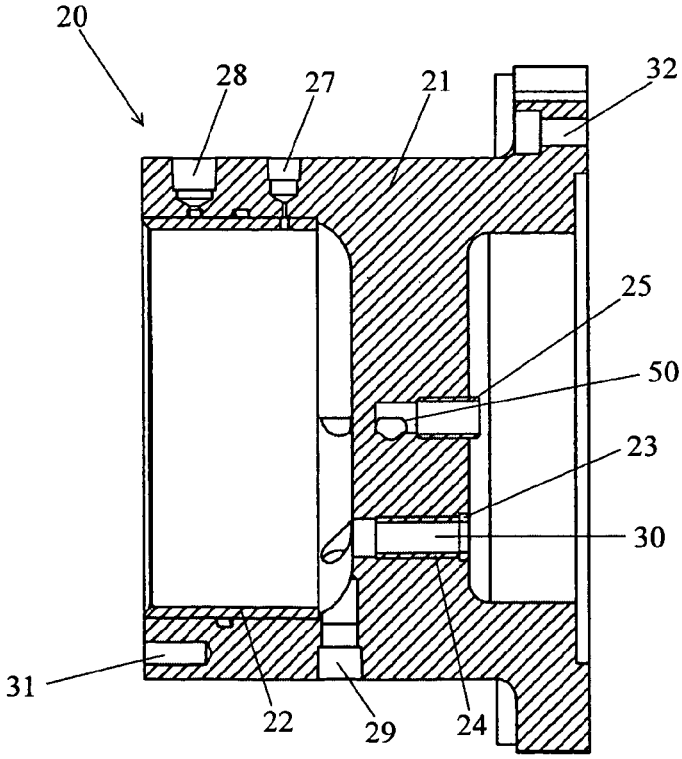
FIG. 7 is a sectional view of the cylinder housing assembly of FIG. 6 taken along line 7-7.
Figure 8:
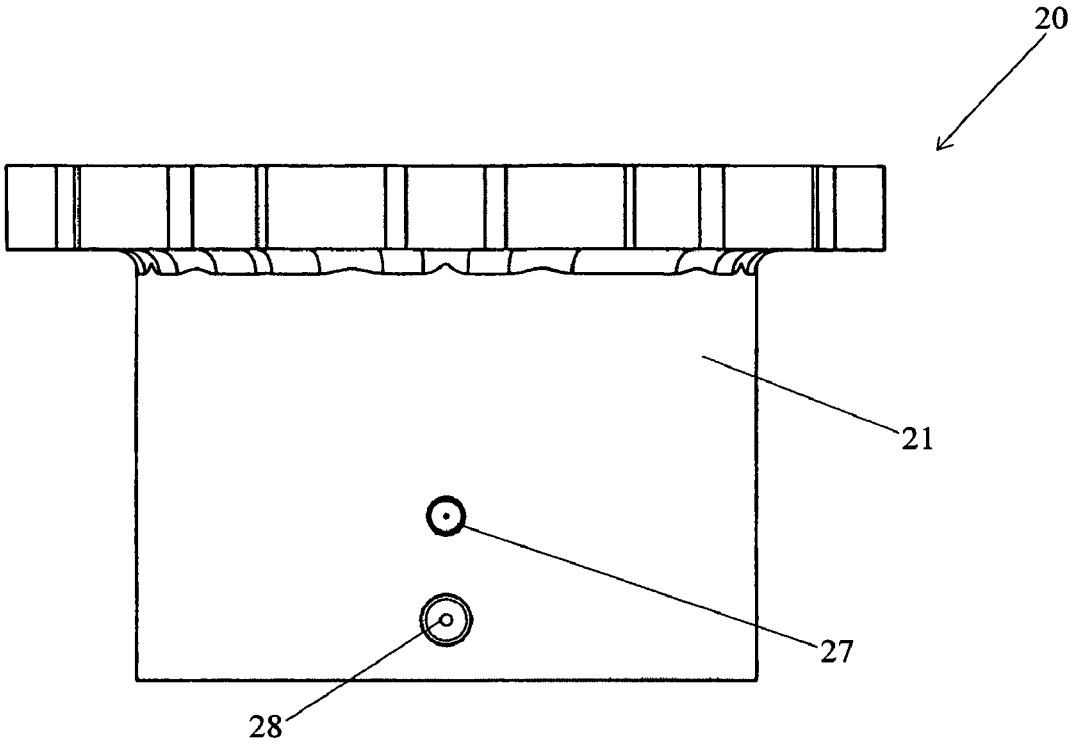
FIG. 8 is a top view of the cylinder housing assembly of FIG. 6.
Figure 9:
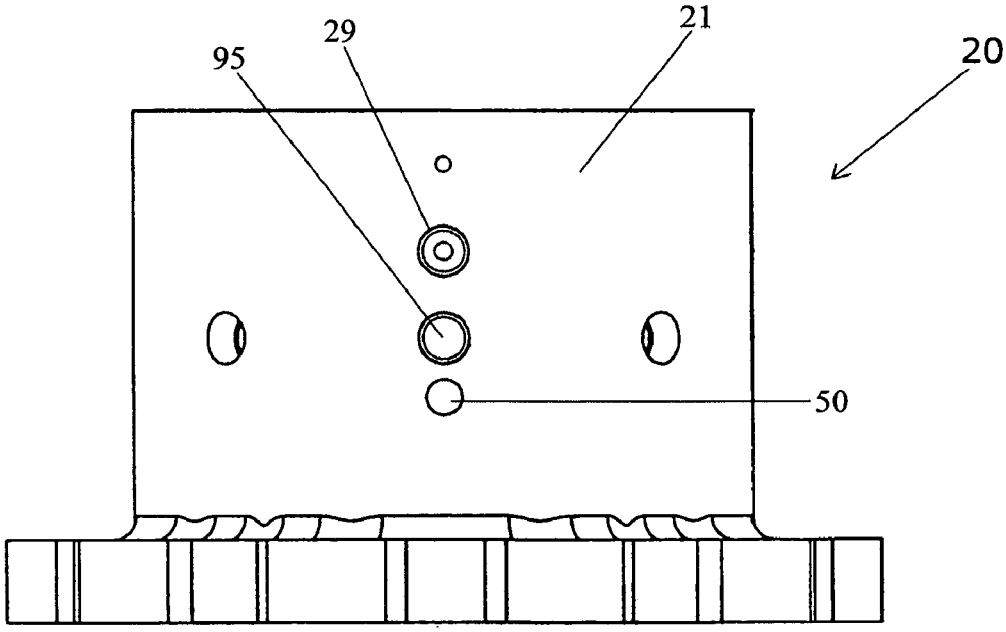
FIG. 9 is a bottom view of the cylinder housing assembly of FIG. 6.

FIGS. 6-9 show cylinder housing 20 having body 21. As shown in FIG. 6, bushings 26 for receiving tension bolts are shown located radially around cylinder housing body 21. Bushing 22 is shown located within and cooperating with cylinder housing body 21. Bushing 22 is preferably made of a ceramic or like low friction material. As shown in FIG. 2, bushing 22 provides a low friction surface for slidably engaging piston seal 93 and annular piston ring 83. Aperture 31 is shown located in body 21 and is utilized for the securement of the cylinder housing body 21 to the cover chamber 65. Specifically, aperture 31 is constructed and arranged to receive fastener 33 shown in FIG. 2. Apertures 32 and 34 are shown radially located around body 21 and are for securement of the cylinder housing to the outer housing assembly 11. Namely, apertures 32 receive fasteners 18 shown in FIGS. 1 and 2 and aperture 34 receives dowel pin 17 shown in FIGS. 3-5. Oil inlet aperture 27, coolant inlet 28 and drain 29 are shown disposed in cylinder housing body 21. FIGS. 8 and 9 show top and bottom views of the cylinder housing assembly 20, showing body 21 having oil inlet aperture 27 and coolant inlet 28 being disposed on the top of body 21 and drains 29, 50 and 95 being disposed on the bottom of body 21. Cylinder housing body 21 is shown generally cylindrical in shape and is preferably made of aluminum or a like material.

Cylinder housing body 21 is further shown in FIGS. 6 and 7 to have push rod seals 23, apertures 30 to receive a push rod, and bushing 24 within apertures 30. Push rods 60, shown in FIGS. 2, 21, 22 and 28 are constructed and arranged to be slidably engaged with the cylinder housing body 21 through apertures 30. Further, centering bushing 25 and drain or channel 50 are shown located in body 21 to aid the passage of air and pressure release resulting from the striking of the dome plug. Drain 50 is shown to outlet on the bottom of cylinder housing body 21 in FIG. 9. As shown in FIG. 2, cavity 92 of dome plug assembly 90, aperture 82 of transfer piston assembly 70, aperture 64 of spring member and centering bushing 25 and drain 50 of cylinder housing assembly 20 are shown in communication with each other and thus forming a pressure release channel through the bottom forming assembly 10. Cylinder housing assembly 20 is preferably constructed of aluminum or other lightweight material to provide a lightweight bottom former assembly with a center of gravity closer to the mounting apparatus on the bodymaker.

Figure 10:
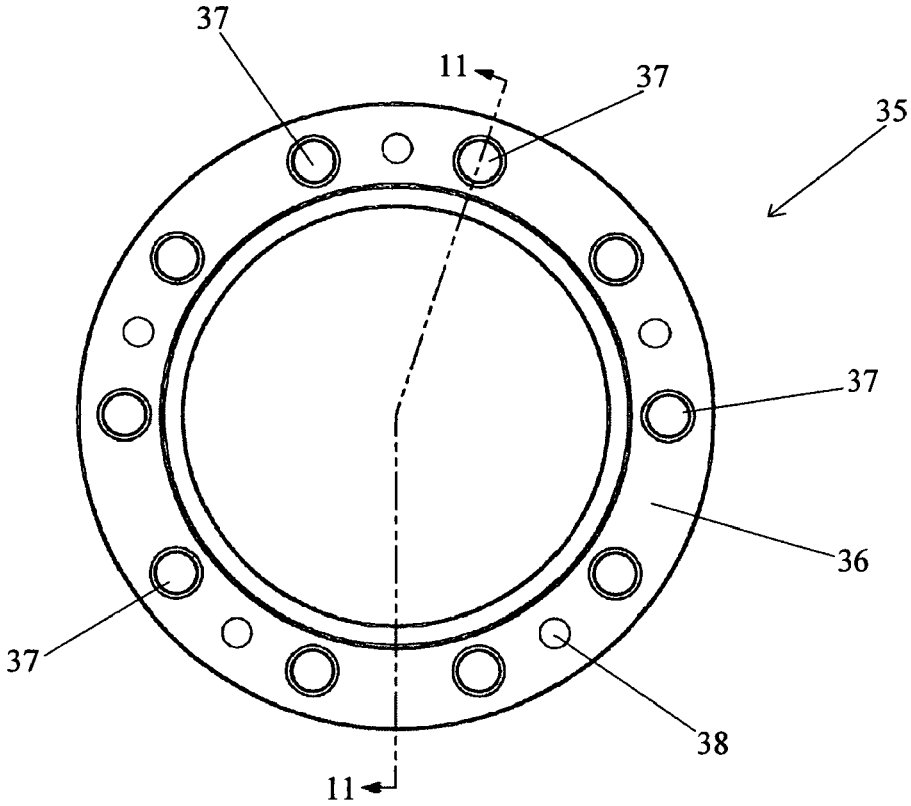
FIG. 10 is a front plan view of the mounting flange assembly of the assembly of FIG. 1.
Figure 11:
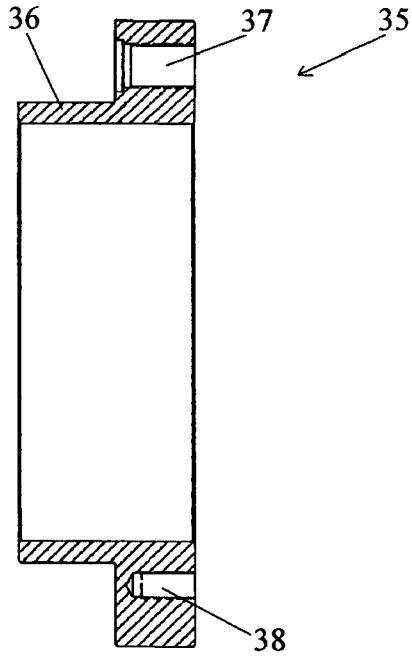
FIG. 11 is a sectional view of the mounting flange assembly of FIG. 10 taken along line 11-11.

FIGS. 10 and 11 show mounting flange 35 having annular body 36, radially positioned apertures 37 for receiving tensions bolts 19 (shown in FIG. 2) and aperture 38 for receiving a fastener (not shown) to fasten mounting flange 35 to locking device 85. Tension bolts 19 and mounting flange 35 are utilized to mount the bottom forming assembly 10 to a bodymaker. The mounting flange 35 is preferably constructed of tool steel or a like material.

Figure 12:
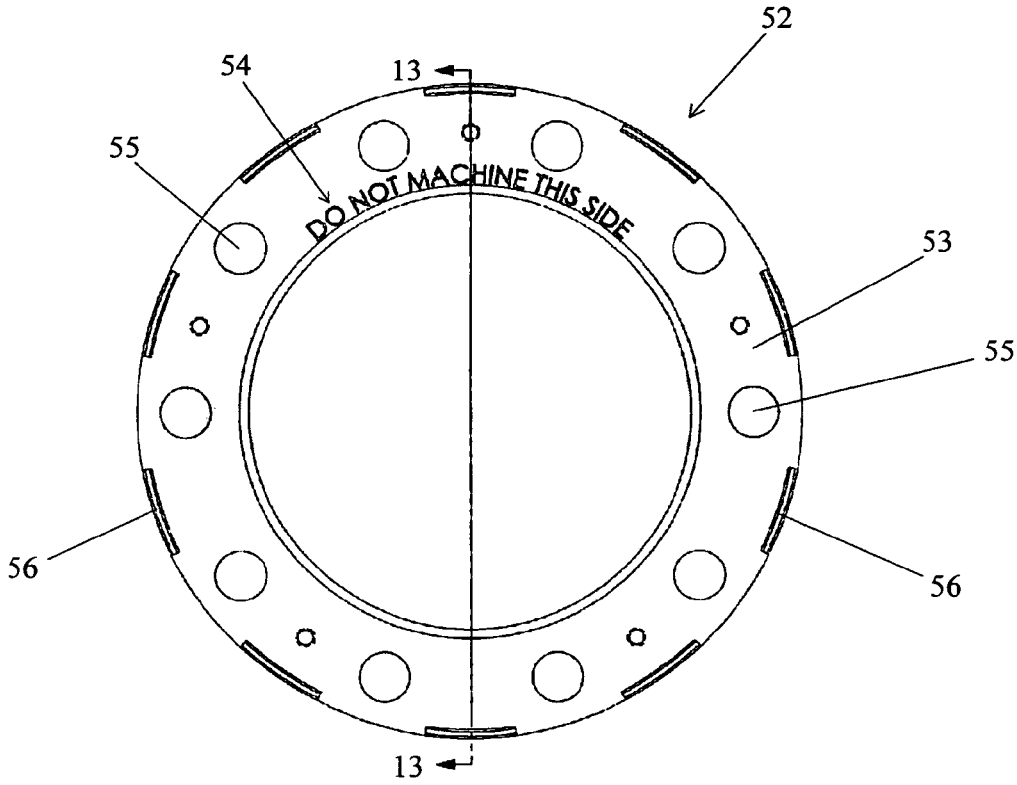
FIG. 12 is a front plan view of the spacer member of the assembly of FIG. 1.
Figure 13:
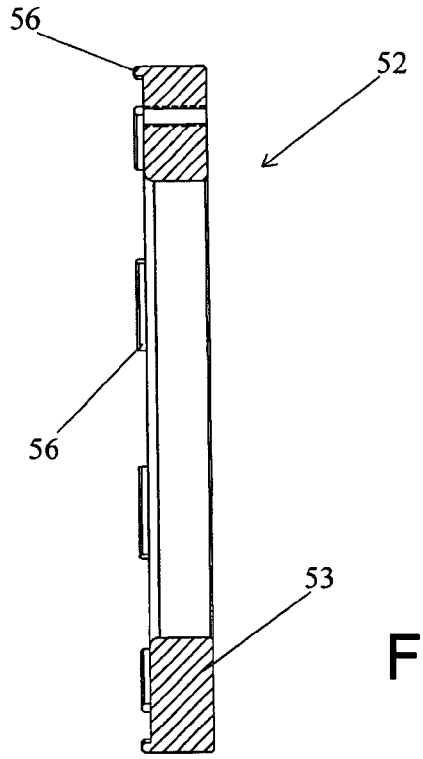
FIG. 13 is a sectional view of the spacer member of FIG. 12 taken along line 13-13.

FIGS. 12 and 13 show spacer member 52 having annular body 53, steps or protrusions 56, apertures 55 and warning indicia 54. Apertures 55 are constructed and arranged to receive tension bolts 19 (shown in FIG. 2). Spacer member 52 is preferably constructed of aluminum or a like material and is designed to be ground to fit the particular bodymaking machine to which the bottom forming assembly is mounted. Spacer member 52 preferably has a hard coating for protection it as spacer member contacts outer housing assembly during use. Because the outer housing assembly is preferably made of tool steel and the spacer member is preferably made of aluminum, the spacer member is preferably coated for toughness to prevent wear due to contact with tool steel or a like hard material. Thus, steps or protrusions 56 and warning indicia 54 are provided on one side of spacer member 52 so that side, i.e., the side that will contact the outer housing assembly, is not ground or machined. Spacer member 52 is preferably constructed of aluminum or other lightweight material to further decrease mass and change the center of gravity of the bottom former.

FIGS. 14-17 show clamp ring retainer assembly 40 having body 41 with peripheral cavities 51 to hold biasing means 44 which float the clamp ring in the bottom forming assembly 10. Clamp ring 43 is shown in use with clamp ring retainer assembly 40 in FIG. 2. Teeth 42 are shown peripherally disposed on body 41 and are constructed and arranged to communicate with teeth 87 of locking device 85 (shown in FIG. 25) to secure and position the clamp ring retainer device. Biasing means 44 are shown comprising cooperating elements, namely, ball member 45, first cap member 46, spring member 47, second cap member 48 and clip member 49, which fit into cavities 51. Preferably, spring member 47 is constructed of urethane or a like compressible material. Ball member 45 is preferably constructed of nitrate or a similar material. Further, it is within the purview of this invention to utilize an alternate spring or biasing means, for example a coil or other mechanical spring structure or other biasing means known in the art. It is further within the purview of this invention to utilize a pin shaped member or a ball shaped member in cooperation with the biasing means.

Figure 14:
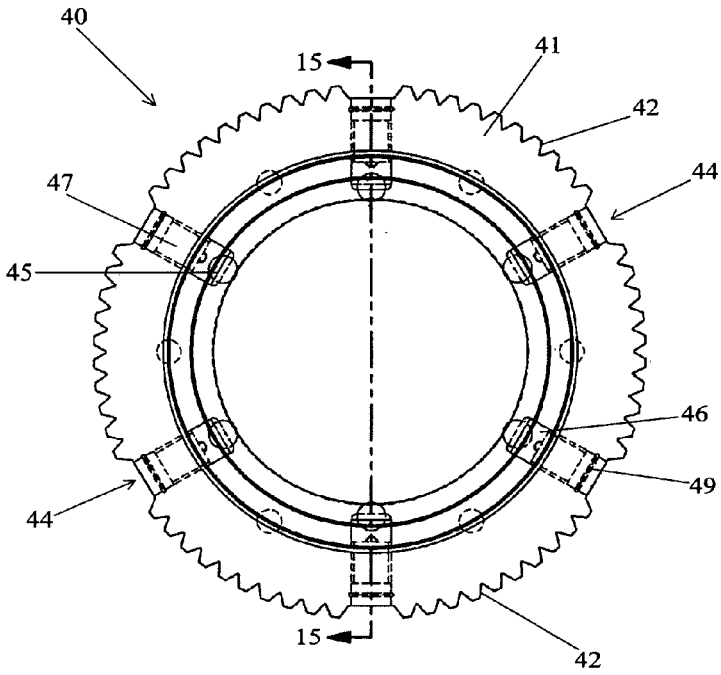
FIG. 14 is a front plan view of the clamp ring retainer assembly of the assembly of FIG. 1.
Figure 15:
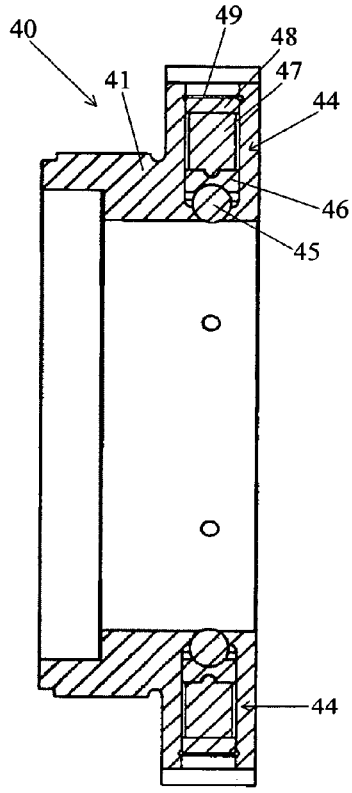
FIG. 15 is a sectional view of the clamp ring retainer assembly of FIG. 14 taken along line 15-15.
Figure 16:
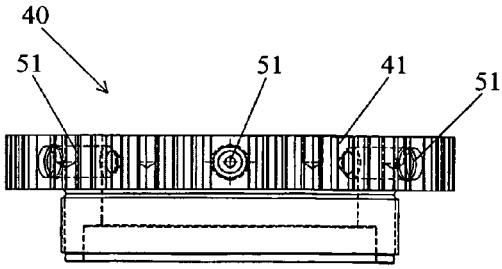
FIG. 16 is a top view of the clamp ring retainer assembly of FIG. 14.
Figure 17:
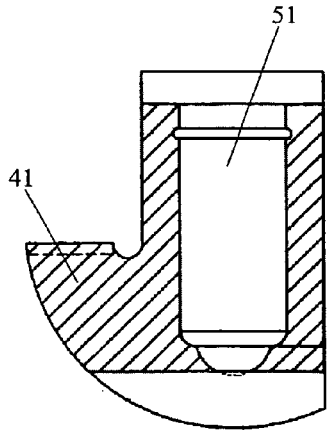
FIG. 17 is an exploded view of the biasing means cavity of the clamp ring retainer assembly of FIG. 16.

Important in this invention is the floating clamp ring 43 and which is the result of the clamp ring retaining assembly 40 having the radially disposed biasing means 44, particularly shown in FIGS. 14-17. Six biasing structures 44 are shown in FIG. 14 equally spaced and radially extending to contact and float the clamp ring 43. As shown in FIG. 17, each cavity 51 is formed to receive the ball member 45, first cap member 46, compressible spring member 47, second cap member 48 and clip member 49. FIGS. 14 and 15 particularly show the spherical ball members 45, cooperating and formed first cap member 46, compressible and cooperating compressible spring member 47 having a centrally disposed protrusion, second cap member 48 and clip member 49. Clip member 49 is shown disposed at the top of the biasing means 44 and is constructed to snap into the groove shown at the top of cavity 51 of FIG. 17. This arrangement compresses the spring member 47 to provide a sufficient preload pressure on the ball member 45 to center and control the float of the clamp ring. The ball member preferably slightly extends from clamp ring retainer body 41 for contact with clamp ring 43. This biasing structure 44 comprising the cooperating elements described, i.e., spherical ball members 45 (nitrite) and compressible springs 47 (urethane), provide a peripherally acting biasing means which float the clamp ring 43.

In use, when the bodymaker punch and can body hits the clamp ring, the floating clamp ring is permitted to center itself around the punch. As the punch continues to travel into the bottom forming assembly, the clamp ring will move the punch so that it and the can body are centered with respect to the bottom forming assembly. The can body is then guided to the domer die plug, where the can bottom is set. The punch forces the can body into the front end of the bottom forming assembly which contains a mold of the desired shape for the can bottom, thereby setting the dome on the bottom of a two piece can. Since the punch is centered with respect to the doming assembly, the likelihood of producing can deformities, i.e., split domes, is reduced, the intended base profile is kept square and ram whip and its effects are reduced. Ram whip results when the punch has finished its forward stroke but whips around as it returns back through the bodymaker. The whipping action may also cause the withdrawing punch to damage the carbide in the ironing dyes, which are expensive to replace. It is therefore beneficial to provide means to center the punch or ram member.

Figure 18:
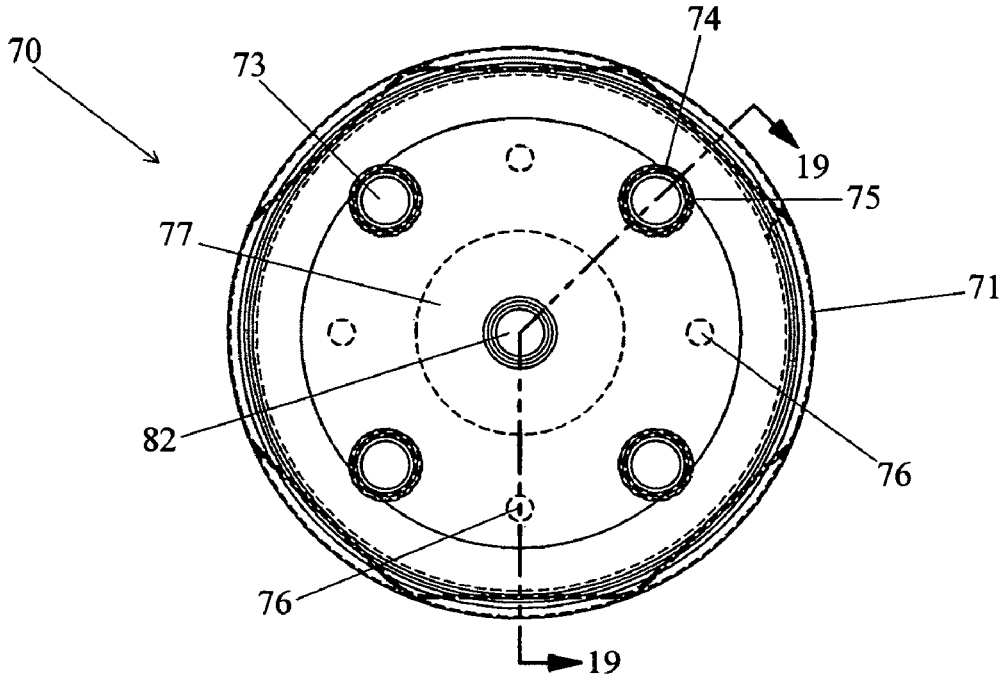
FIG. 18 is a plan view of the transfer piston assembly of FIG. 1.
Figure 19:
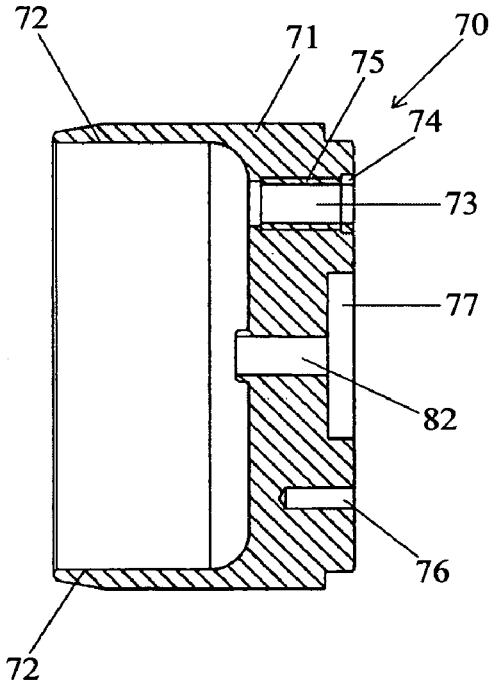
FIG. 19 is a sectional view of the transfer piston assembly of FIG. 18 taken along line 19-19.

FIGS. 18 and 19 show transfer piston assembly 70 having body 71. Apertures 76 are shown and are constructed and arranged to receive fasteners 78 for securement of transfer piston body 71 to domer die plug assembly 90, as shown in FIG. 2. Transfer piston body 71 is shown having centrally disposed indented portion 77, which is constructed and arranged to matingly receive domer die plug body 91. Apertures 73 are shown each having push rod seal 74 and bushing 75, preferably constructed of a polymeric composite material or like low friction material, to slidably engage push rods 60. FIG. 19 is a cross sectional view of transfer piston assembly 70 and shows tapered portion 72 of body 71. Overtravel measuring device 94, as discussed with respect to FIG. 4, is constructed and arranged to cooperate with tapered portion 72 to measure any overtravel within the bottom forming assembly 10. Aperture 82 is shown centrally disposed in transfer piston body 71 and provides a channel for pressure release when the bottom forming assembly is in use, as discussed above. Transfer piston body is preferably made of tool steel or a like material and is constructed and arranged to slidably move within bushing 12 (shown in FIG. 2) which is preferably made of a polymeric composite material or a similar low friction material.

Figure 20:
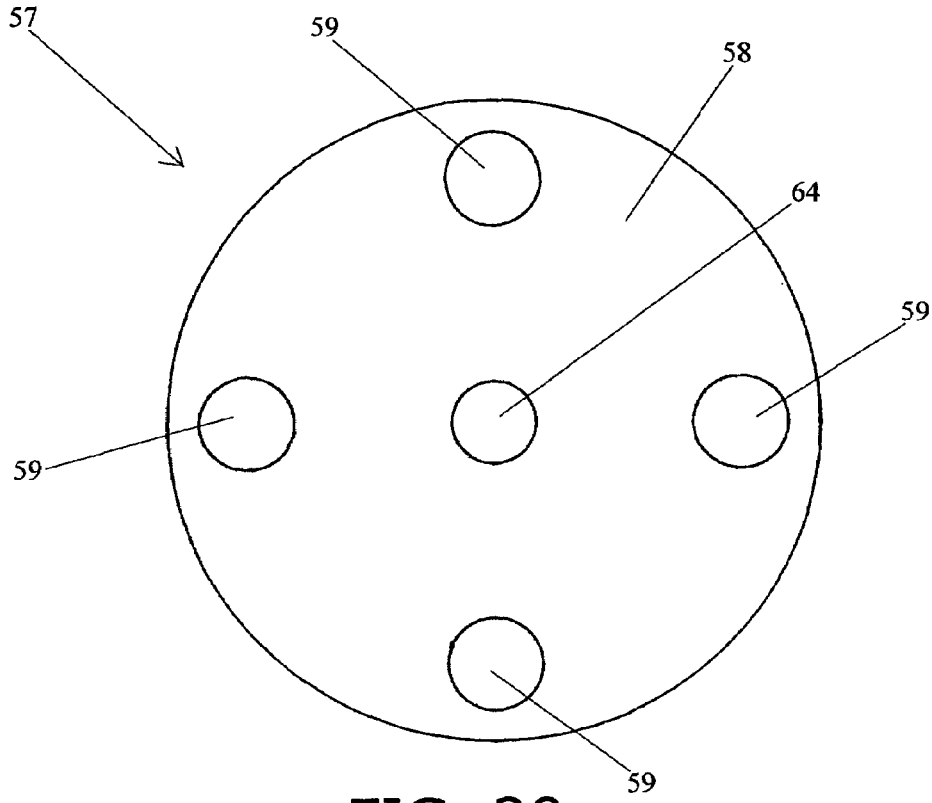
FIG. 20 is a front plan view of the spring member of the assembly of FIG. 1.
Figure 21:
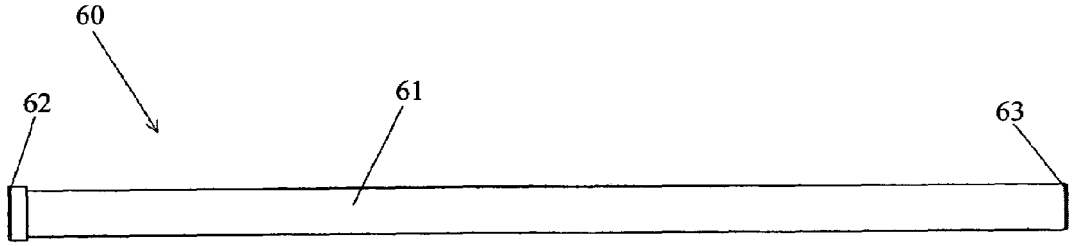
FIG. 21 is a top plan view of the push rod member of the assembly of FIG. 1.
Figure 22:
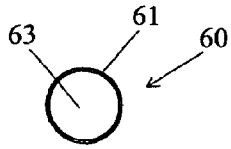
FIG. 22 is a front plan view of the push rod member of FIG. 21.
Figure 28:
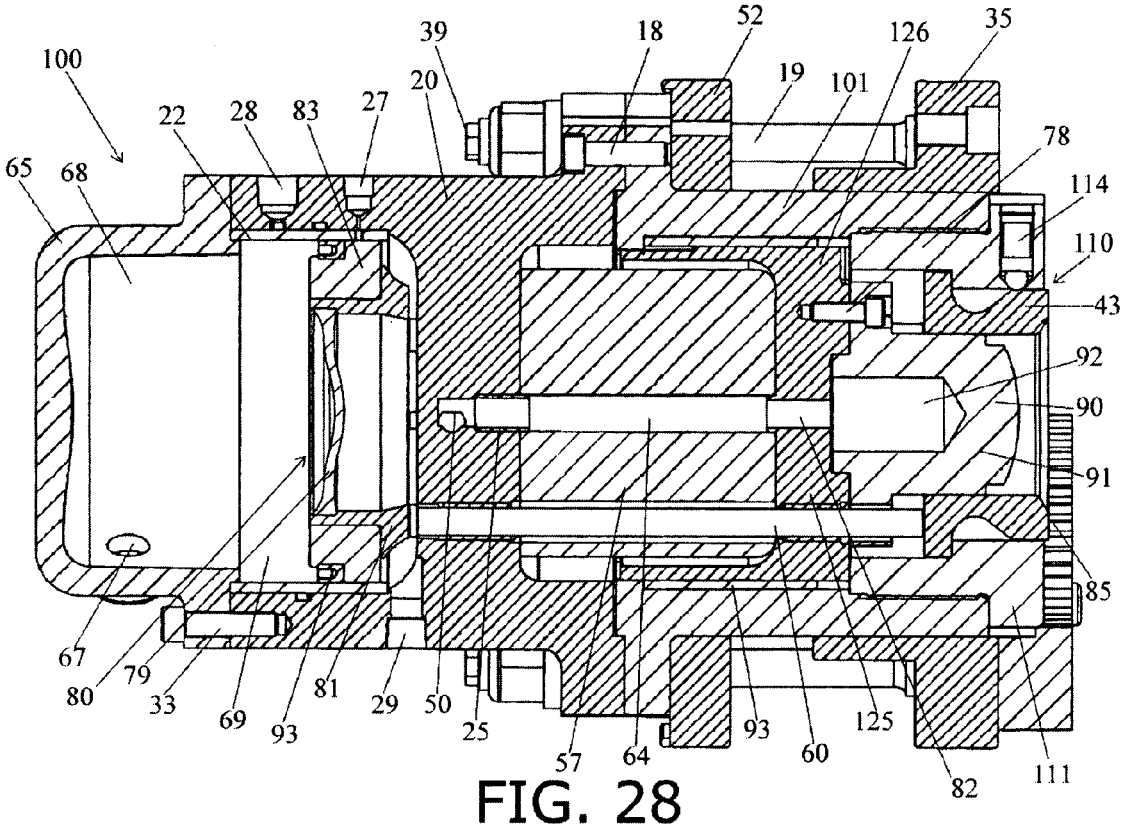
FIG. 28 is a sectional view of the bottom forming assembly of FIG. 27 taken along line 28-28.

FIG. 20 shows spring member 57 having body 58 having radial apertures 59 and central aperture 64. Aperture 64 is shown centrally disposed in spring member body 58 and provides a channel for pressure release when the bottom forming assembly 10 is in use, as discussed above. Aperture 64 is further constructed and arranged to cooperate with centering bushing 25 of cylinder housing assembly 20 and provides a centering mechanism for spring member 57. Spring member 57 is preferably constructed of urethane or a like compressible material. As shown in FIGS. 2 and 28, spring member 57 is centrally positioned within the bottom former assemblies of this invention. This placement allows for optimal spring size, i.e., length and diameter. It has been found that large spring diameter and length is optimal for absorbing forces in the bottom former environment. Apertures 59 are constructed and arranged to receive push rods 60 extending therethrough, which are shown in FIGS. 21-22. Push rods 60 are shown having an elongated cylindrical body 61 with ends 62 and 63, so that the push rod is properly placed in bottom forming assembly 10. Specifically, capped end 62 is shown provided and permits the push rods to be placed within the bottom former in the proper manner to prevent push rod seals from damage.

As shown in FIG. 2, transfer piston assembly 70 slidably moves within bushing 13 when force is exerted upon dome plug assembly 90. Thus, spring member 57 is compressed, thereby, absorbing some of the force. Clamp ring 43 is shown abutting push rods 60 in FIGS. 2 and 28. FIG. 18 shows four apertures 73 in transfer piston assembly 70 for receiving push rods 60. Push rods 60 extend through spring member 57 through four apertures 58, shown in FIG. 20. Push rods terminate at piston assembly 80. Piston assembly 80 is shown in FIG. 2 and 28 comprised of annular piston wall 81, annular piston ring 83 and piston end member 79. When force is exerted on clamp ring 43 and dome plug 90, transfer piston assembly 70 moves within bushing 13, compresses spring member 57, thus push rods 60 transfer force on piston assembly 80, which moves within bushing 22 and chamber 69. Bushing 22 is preferably made of a ceramic or like low friction material, and bushing 13 is preferably made of a polymeric composite material or like low friction material.

Figure 23:
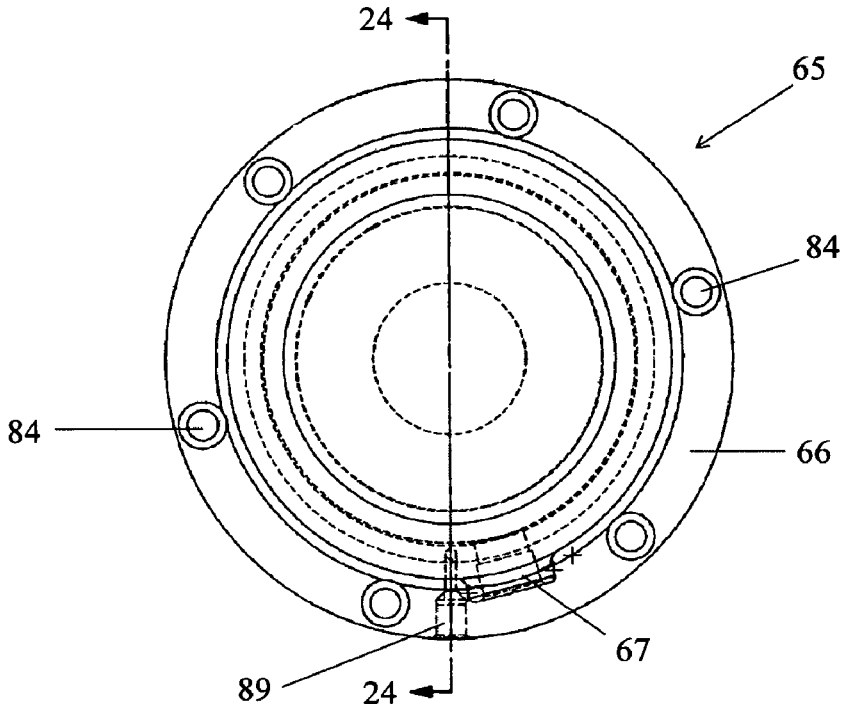
FIG. 23 is a front plan view of the cover chamber assembly of the assembly of FIG. 1.
Figure 24:
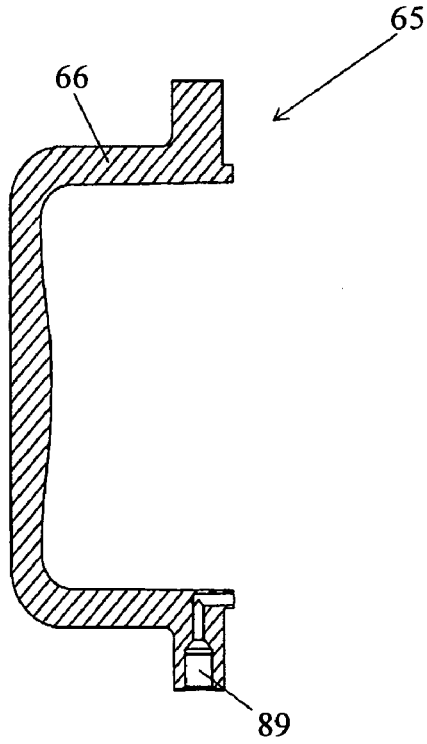
FIG. 24 is a sectional view of the cover chamber assembly of FIG. 23 taken along line 24-24.

FIGS. 23 and 24 show cover chamber assembly 65 having body 66. Body 66 is shown having cleaning port 89 and pressurized air line aperture 67. Apertures 84 are shown disposed radially around cover chamber 65 and are for use with fasteners 33 to secure the cover chamber 65 to the cylinder housing assembly 20. As shown in FIG. 2, cover chamber 65 is shown disposed at the end of bottom forming assembly 10 and defining chamber 68. When the bottom former is used, the air inside the bottom former is compressed due to the punch of the ram and the stroke of the piston assembly within the bottom former. Chamber 68 and pressurized air line aperture 67 provides release for this built-up pressure. Cleaning port 89 can be opened to clean or blow out excess coolant and air. Cover chamber assembly 65 is preferably constructed of aluminum or like lightweight material to reduce mass and change the center of gravity of the bottom former.

Figure 25:
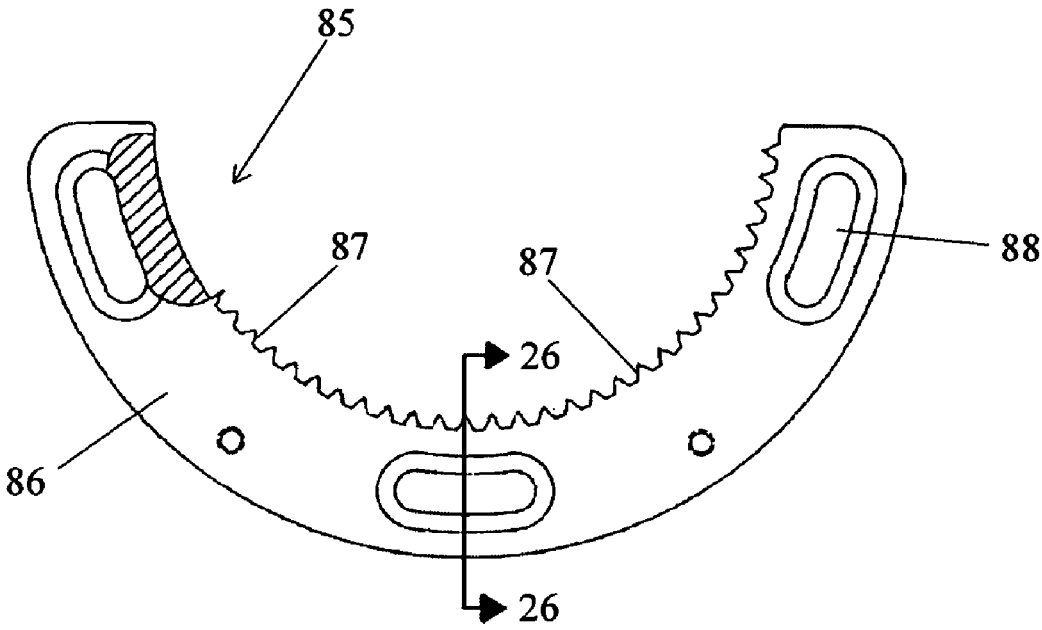
FIG. 25 is a front plan view of the locking device of the assembly of FIG. 1.
Figure 26:
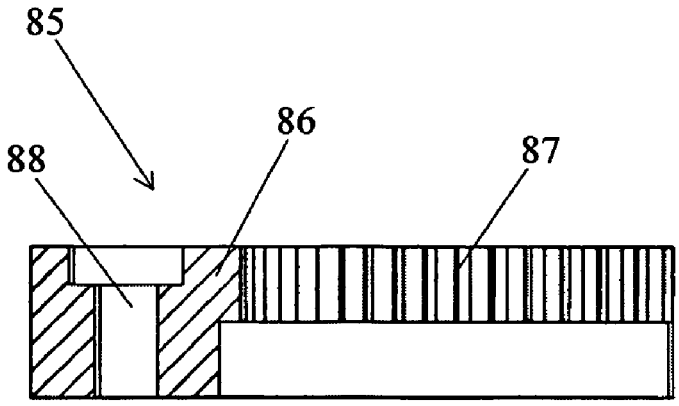
FIG. 26 is a sectional view of the locking device of FIG. 25 taken along line 26-26.

FIGS. 25 and 26 show locking device 85 having body 86 and teeth 87. Apertures 88 are shown and are for securement of the locking device 85 to the clamp ring retainer assembly 40. As discussed above, teeth 87 of locking device body 86 cooperate with teeth 42 of clamp ring retainer body 41 to secure the clamp ring retainer assembly in place.

FIGS. 27-35 show a second embodiment 100 of a bottom forming assembly of the present invention. The bottom forming assembly 100 is generally comprised of the same components as bottom forming assembly 10, however, several components have a different configuration than the corresponding components of assembly 10 and provide advantages to the bottom forming assembly 100. For example, in assembly 100, outer housing assembly 101, clamp ring retainer assembly 110 and transfer piston assembly 125 have different configurations than the corresponding component assemblies of bottom forming assembly 10.

Figure 27:
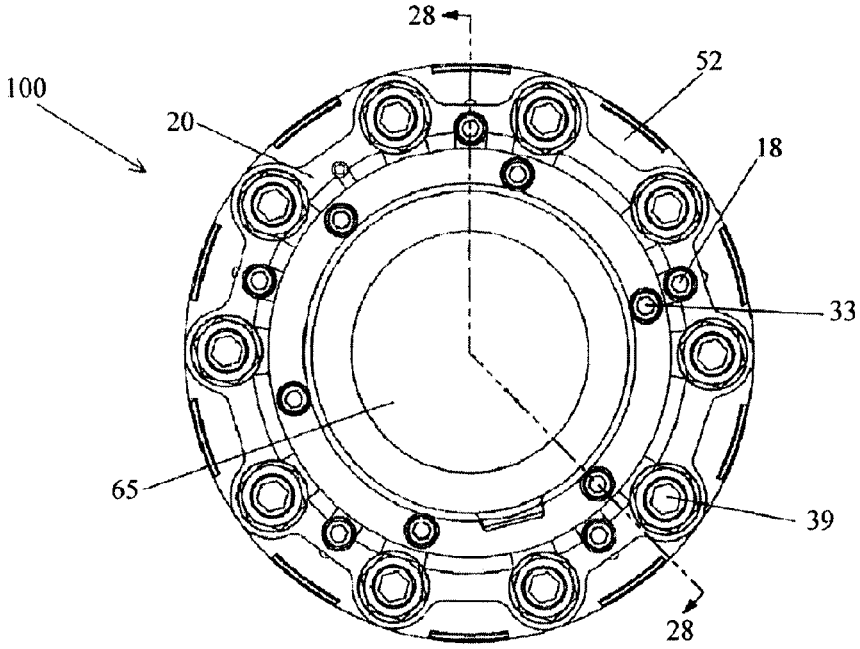
FIG. 27 is a front plan view of an alternate embodiment of a can bottom forming assembly of the present invention.

Referring to FIGS. 27 and 28, bottom forming assembly 100 is shown having outer housing assembly 101 and cylinder housing assembly 20. Clamp ring retainer assembly 110 having biasing means 114 is shown at the front of the bottom forming assembly and for holding and floating clamp ring 43. Clamp ring retainer assembly 110 is shown held in place by locking device 85. The clamp ring retainer assembly 110 is shown positioned adjacent dome plug assembly 90 and abutting transfer piston assembly 125. As shown in FIG. 28 and in contrast with FIG. 2, the transfer piston body 126 is shown to abut only clamp ring retainer body 111 and not the outer housing body, as shown in the assembly of FIG. 2. Outer housing assembly is shown having bushing 103 which slidingly engages transfer piston assembly 125. Transfer piston assembly 125 is shown attached to dome plug assembly 90 via fastener 78. Transfer piston assembly 70 is shown adjacent spring member 57 and push rods 60 are shown extending from transfer piston assembly 125 and through spring member 57. Push rod 60 is shown ending at piston assembly 80 which abuts and moves within chamber 69 in bushing 22. Cylinder housing assembly 20 is shown attached to outer housing assembly using fasteners 18. Cover chamber 65 is shown forming chamber 68 attached to the end of the bottom forming assembly 100, namely to cylinder housing 20, using fastener 33. Cylinder housing 20 is shown having oil inlet aperture 27, coolant inlet 28, and drain 29. The bottom forming assemblies of this invention are constructed and arranged to be attached to a bodymaker using mounting flange 35, spacer 52 and tension bolts 19 having hex-heads 39.

Figure 29:
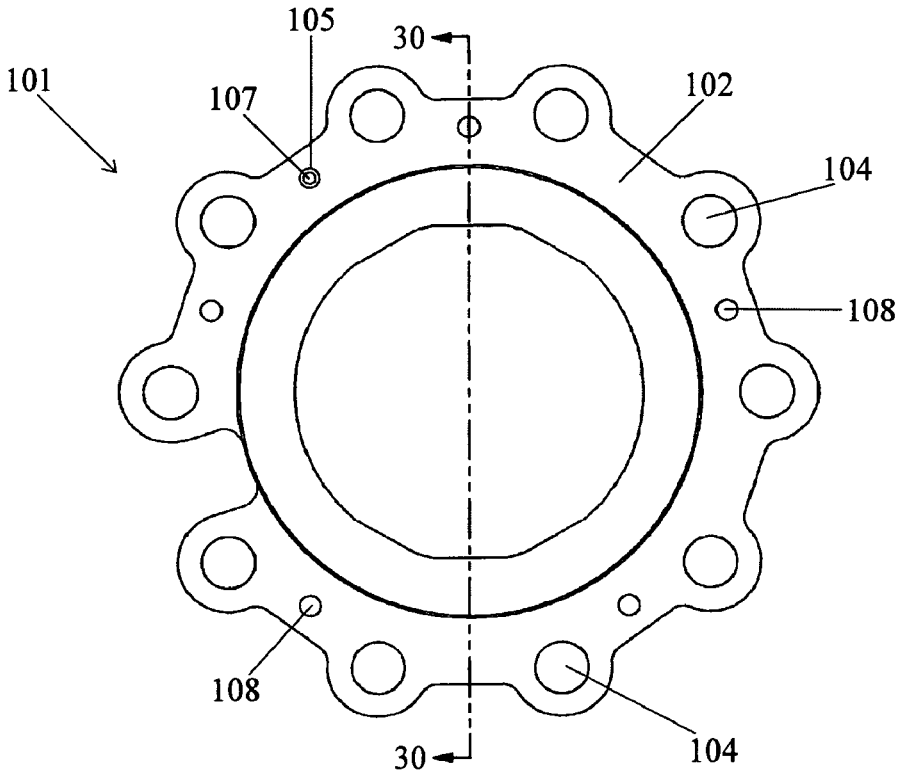
FIG. 29 is a front plan view of the outer housing assembly of the assembly of FIG. 27.
Figure 30:
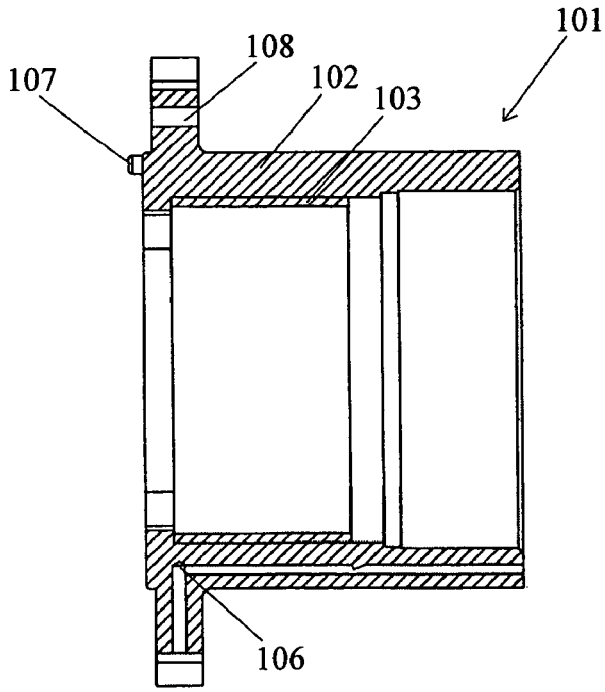
FIG. 30 is a sectional view of the outer housing assembly of FIG. 27 taken along line 30-30.

FIGS. 29 and 30 show outer housing assembly 101 having generally annular body 102 and cooperating with bushing 103. Outer housing assembly is preferably constructed of tool steel or a like hard material. Bushing 103 is preferably constructed of a polymeric composite material or a similar material. Apertures 104 are shown and are constructed and radially arranged to receive tension bolts 19 (shown in FIG. 28). Apertures 108 are shown and are constructed and arranged to receive fasteners 18. Dowel pin 107 in aperture 105 is further utilized to secure outer housing assembly in aperture 34 of cylinder housing body 21, which is discussed above with respect to FIG. 6. Drain 106 is shown to drain excess coolant or oil. As further discussed above with respect to FIGS. 3-5, it is desirable to measure the overtravel movement of the transfer piston assembly, for example using overtravel measuring structure 94 (shown in FIG. 4), to monitor the movement within the bottom forming assembly and make necessary adjustments, for example changing the spring member if excessive travel is detected.

Figure 31:
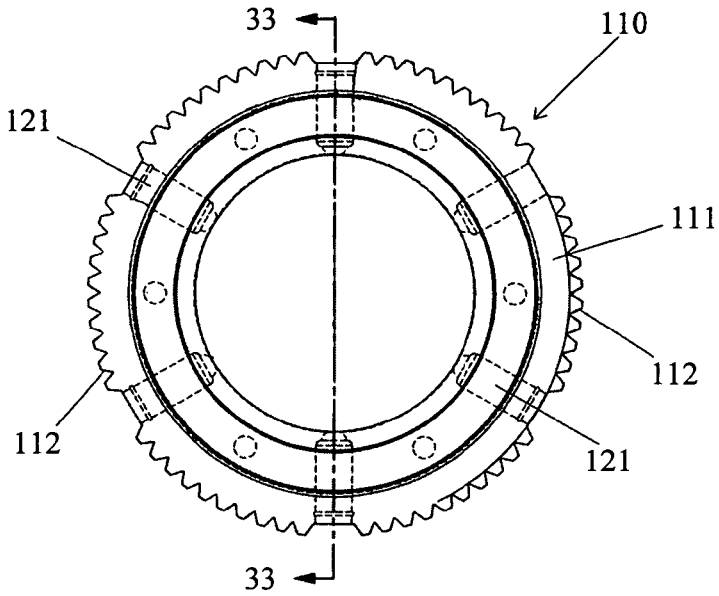
FIG. 31 is a front perspective view of the clamp ring retainer assembly of the assembly of FIG. 27.
Figure 32:
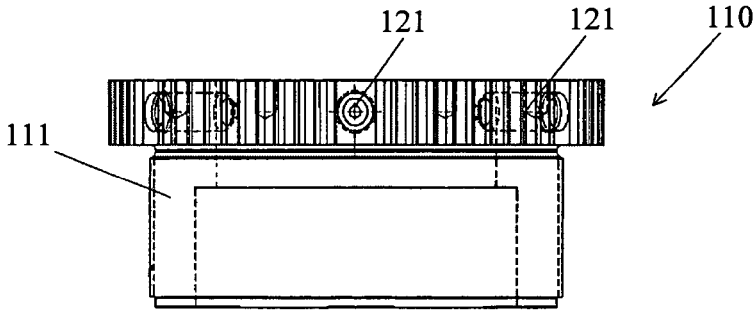
FIG. 32 is a top view of the clamp ring retainer assembly of FIG. 31.
Figure 33:
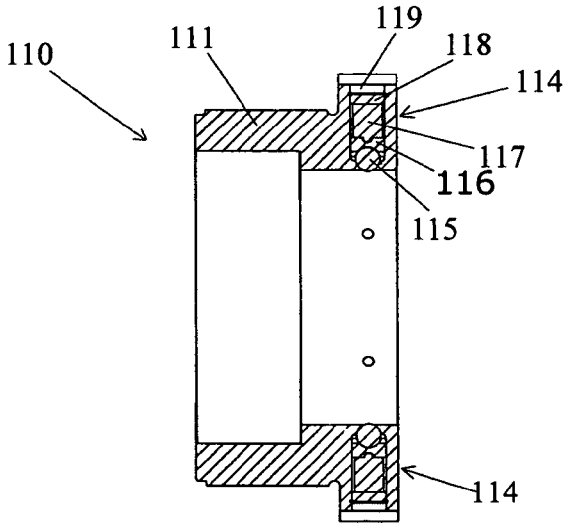
FIG. 33 is a sectional view of the clamp ring retainer assembly of FIG. 31 taken along line 33-33, showing the biasing means positioned in the cavity.

FIGS. 31-33 show clamp ring retainer assembly 110 having annular body 111 with cavities 121 to hold biasing means 114 which float the clamp ring in the bottom forming assembly. Teeth 112 are shown and are constructed and arranged to communicate with teeth 87 of locking device 85 (shown in FIG. 25) to secure and position the clamp ring retainer device. Biasing means 114 are shown comprising cooperating elements, namely, ball member 115, cap member 116, spring member 117, cap member 118 and clip member 119, which fit into cavities 121. Preferably, each spring member is made of urethane or a like compressible material and each ball member is made of nitrite or a like hard material.

Figure 34:
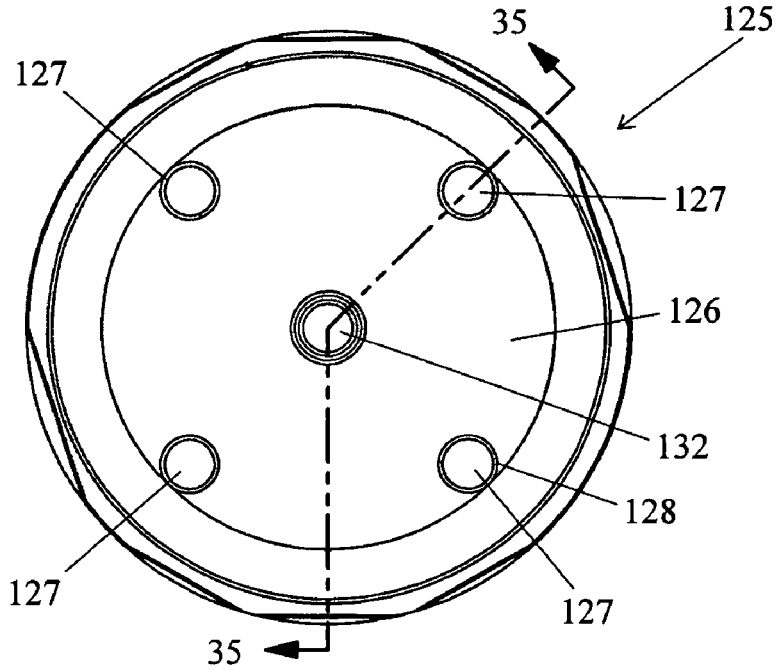
FIG. 34 is a plan view of the transfer piston assembly of FIG. 27.
Figure 35:
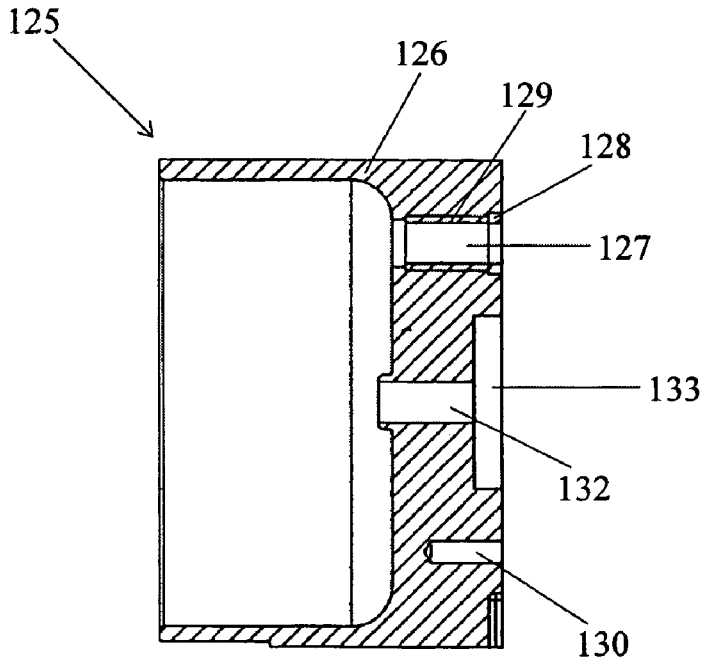
FIG. 35 is a sectional view of the transfer piston assembly of FIG. 34 taken along line 35-35.

FIGS. 34 and 35 show transfer piston assembly 125 having body 126. Apertures 130 are shown and are constructed and arranged to receive fasteners 78 for securement of transfer piston body 126 to domer die plug 90. Transfer piston body 126 is shown having indented portion 133, which is constructed and arranged to matingly receive domer die plug 90. Apertures 127 are shown having push rod seal 128 and bushing 129, preferably made of a polymeric composite material or like low friction material, to slidably engage push rods 60.

Thus, the second embodiment 100 of the bottom former includes alternate configurations of the outer housing assembly, clamp ring retainer assembly and transfer piston assembly. The alternate components are constructed and arranged to cooperate with each other in such a way that as the transfer piston assembly returns to its original position after the force of the bodymaker punch, the transfer piston assembly engages and strikes only the clamp ring retainer assembly and not the outer housing assembly. The outer housing assembly, transfer piston assembly and the clamp ring retainer assembly are preferably constructed of tool steel or a like hard material. By providing the alternate configurations of the outer housing assembly, the clamp ring retainer assembly and the transfer piston assembly, servicing and tooling of the bottom former are simplified.

The alternate embodiment 100 further provides ease of service to the inside of the bottom forming assembly. The spring member located inside the bottom former may need changing as well as various hardware inside the bottom former. For example, to access the spring in the first embodiment of bottom forming assembly, the ten tension bolts with their hex-heads are unscrewed and removed, the cylinder housing is removed and the spring may be changed and putting the bottom former back together requires reassembly of the ten tension bolts. Alternatively, to access the spring inside the second embodiment bottom former, the door of the bodymaker is opened, the clamp ring and retainer, dome plug and transfer piston assemblies are removed. Thus, the ten tension bolts which hold the bottom former to the bodymaker door through the mounting flange, spacer, and outer and cylinder housings need not be removed.

In summary, the present invention provides improved bottom forming assemblies that include a novel arrangement of bottom former components, a lightweight construction and a biasing means to float the clamp ring. By arranging the components in the manner shown and described herein and constructing many of the parts of aluminum instead of tool steel, the center of gravity of the bottom former assembly is moved closer to the mounting apparatus on the bodymaker, thereby preventing the bottom forming assembly from sagging and becoming out of alignment with the bodymaker punch. By providing biasing means to float the clamp ring and thereby guide the bodymaker punch, the bottom former is further improved.

As many changes are possible to the embodiments of the assemblies of this invention utilizing the teachings thereof, the descriptions above, and the accompanying drawings should be interpreted in the illustrative and not in the limited sense.

That which is claimed is:

1. A can bottom forming assembly for forming the bottom of a can body and for attachment to a bodymaker having a punch, said bottom forming assembly comprising:

a) a housing assembly having an outer housing, a cylinder housing and a cover chamber;

b) a clamp ring retainer assembly having biasing means to float a clamp ring, wherein said clamp ring retainer assembly is constructed and arranged to be partially positioned within said outer housing;

c) a clamp ring and a domer die plug for contact with the can body;

d) a piston assembly having a transfer piston assembly, push rods and an end piston assembly, wherein said transfer piston is positioned for sliding engagement within said outer housing and wherein said end piston assembly is positioned for sliding engagement within said cylinder housing and wherein said domer die plug is in communication with said transfer piston assembly;

e) a spring member constructed and arranged for placement between said transfer piston assembly and said end piston assembly and wherein said push rods extend through said spring member and are constructed and arranged for sliding engagement in said spring member; and f) means to attach the can bottom forming assembly to a bodymaker assembly.

2. The can bottom forming assembly of claim 1, wherein said biasing means of said clamp ring retainer assembly comprises a plurality of biasing members each comprising a compressible spring member and a cooperating rigid ball member, each said ball member having a generally spherical shape.

3. The can bottom forming assembly of claim 2, wherein said spring member is constructed of urethane and said ball member is constructed of nitrite.

4. The can bottom forming assembly of claim 1, further having a polymeric composite bushing and wherein said transfer piston assembly moves within said outer housing via said bushing.

5. The can bottom forming assembly of claim 1, further having a ceramic bushing and wherein said end piston assembly moves within said cylinder housing via said ceramic bushing.

6. The can bottom forming assembly of claim 1, wherein said cylinder housing contains oil and coolant inlet and outlet means.

7. The can bottom forming assembly of claim 1, wherein said cover chamber includes an aperture for receiving a pressurized air line.

8. The can bottom forming assembly of claim 1, wherein said spring member has a centrally positioned bore for centering purposes and pressure release and is constructed of urethane.

9. The can bottom forming assembly of claim 1, wherein said cover chamber and said cylinder housing are constructed of aluminum and wherein said outer housing, clamp ring retainer assembly and said piston assembly are constructed of tool steel.

10. The can bottom forming assembly of claim 1, wherein said means to attach includes a mounting flange and at least one tension bolt.

11. The can bottom forming assembly of claim 1, wherein said means to attach further includes at least one spacer member.

12. The can bottom forming assembly of claim 1, wherein said assembly further comprises a locking means constructed and arranged to secure said clamp ring retainer assembly.

13. A can bottom forming assembly for attachment to a bodymaker having a punch, said bottom forming assembly comprising:

a) a housing assembly having a floating clamp ring to center the movement of the punch;

b) a clamp ring retainer assembly having a plurality of formed cavities, said clamp ring retainer surrounding said floating clamp ring and said cavities having an opening facing said clamp ring;

c) biasing means positioned in each said formed cavity for centering said floating clamp ring assembly, said biasing means comprising a ball pin structure and a cooperating compressible member; and d) said housing assembly further comprising an outer housing, a cylinder housing, a cover chamber and wherein said can bottom forming assembly further includes a domer die plug for contact with the can body, a piston assembly having a transfer piston assembly, rush rods and an end piston assembly, a spring member constructed and arranged for placement between said transfer piston assembly and said end piston assembly, and means to attach the can bottom forming assembly to a bodymaker assembly, wherein said clamp ring retainer assembly is constructed and arranged to be partially positioned within said outer housing, wherein said transfer piston is positioned for sliding engagement within said outer housing and wherein said end piston assembly is positioned for sliding engagement within said cylinder housing and wherein said domer die plug is in communication with said transfer piston assembly, wherein said push rods extend through said spring member and are constructed and arranged for sliding engagement in said spring member.

14. The can bottom forming assembly of claim 13, wherein said ball pin member has a generally spherical shape and is constructed of nitrite and wherein said cooperating compressible member is constructed of a urethane composition, and wherein said assembly further has a bushing formed of a polymeric composite and wherein said transfer piston assembly moves within said outer housing via said bushing.

15. The can bottom forming assembly of claim 13, wherein said spring member is constructed of urethane, wherein said cover chamber and said cylinder housing are constructed of aluminum and wherein said outer housing, clamp ring retainer assembly and said piston assembly are constructed of tool steel.

16. The can bottom forming assembly of claim 13, wherein each said push rod has a body having a diameter and an end portion having a diameter larger than the diameter of said body.

17. A can bottom forming assembly for forming the bottom of a can body and for attachment to a bodymaker having a punch, said bottom forming assembly comprising:

a) a housing assembly having an outer housing, a cylinder housing and a cover chamber, said cover chamber defining a pressure relief chamber;

b) a clamp ring and a domer die plug for contact with the can body;

c) a clamp ring retainer assembly having biasing means to float said clamp ring, wherein said clamp ring retainer assembly is constructed and arranged to be partially positioned within said outer housing and wherein said means to float said clamp ring comprises a ball pin member having a generally spherical shape and a cooperating compressible member;

d) a piston assembly having a transfer piston assembly, at least one push rod and an end piston assembly, wherein said transfer piston assembly is in communication with said domer die plug and is positioned for sliding engagement within said outer housing, wherein said end piston assembly is positioned for sliding engagement within said cylinder housing and wherein said at least one push rod extends between said transfer piston assembly and said end piston assembly;

e) a spring member constructed and arranged for placement between said transfer piston assembly and said end piston assembly and wherein said at least one push rod extends through said spring member and is constructed and arranged for sliding engagement in said spring member; and f) means to attach the can bottom forming assembly to a bodymaker assembly.

18. The can bottom forming assembly of claim 17, wherein said ball pin member is constructed of nitrite and said cooperating compressible member is constructed of urethane and wherein said assembly further has a polymeric composite bushing and wherein said transfer piston assembly moves within said outer housing via said bushing.

19. The can bottom forming assembly of claim 17, wherein said transfer piston assembly contacts said clamp ring retainer assembly when at rest and wherein said spring member is constructed of urethane, wherein said cover chamber and said cylinder housing are constructed of aluminum and wherein said outer housing, clamp ring retainer assembly and said piston assembly are constructed of tool steel.

* * * * *

UNITED STATES PATENT AND TRADEMARK OFFICE

CERTIFICATE OF CORRECTION

PATENT NO. : 7,290,428 B2
APPLICATION NO. : 11/346132
DATED : November 6, 2007
INVENTOR(S) : Mark L. Zauhar It is certified that error appears in the above-identified patent and that said Letters Patent is hereby corrected as shown below:

Column 11, line 48 please change the word “rush” to --push--.

Signed and Sealed this

Eleventh Day of March, 2008

JON W. DUDAS
*Director of the United States Patent and Trademark Office*